US011299953B2

(12) United States Patent
Johnson et al.

(10) Patent No.: US 11,299,953 B2
(45) Date of Patent: Apr. 12, 2022

(54) SEATING ASSEMBLY INCLUDING A CONVERTIBLE LANDING SEAT

(71) Applicants: Michael Johnson, Katy, TX (US); Matthew Stone, Humble, TX (US); Colin Andrew, Cypress, TX (US)

(72) Inventors: Michael Johnson, Katy, TX (US); Matthew Stone, Humble, TX (US); Colin Andrew, Cypress, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/399,558

(22) Filed: Apr. 30, 2019

(65) Prior Publication Data

US 2020/0347692 A1 Nov. 5, 2020

(51) Int. Cl.

| | |
|---|---|
| ***E21B 34/14*** | (2006.01) |
| ***E21B 33/00*** | (2006.01) |
| ***E21B 33/12*** | (2006.01) |
| *E21B 43/26* | (2006.01) |
| *E21B 34/10* | (2006.01) |

(52) U.S. Cl.

CPC ..... *E21B 33/12* (2013.01); *E21B 34/14* (2013.01); *E21B 34/10* (2013.01); *E21B 43/26* (2013.01)

(58) Field of Classification Search

CPC .... E21B 34/14; E21B 34/142; E21B 2200/06; E21B 33/00

See application file for complete search history.

(56) References Cited

U.S. PATENT DOCUMENTS

| | | | | |
|---|---|---|---|---|
| 7,866,397 | B2 * | 1/2011 | Lee | E21B 21/103 166/318 |
| 9,297,234 | B2 * | 3/2016 | Themig | E21B 34/08 |
| 9,562,419 | B2 * | 2/2017 | Fleckenstein | E21B 34/063 |
| 2011/0030968 | A1 | 2/2011 | Xu | |
| 2011/0198100 | A1 | 8/2011 | Braekke et al. | |
| 2016/0040508 | A1 | 2/2016 | Webster et al. | |
| 2016/0115765 | A1 | 4/2016 | Brække et al. | |
| 2017/0204700 | A1 | 7/2017 | Hughes et al. | |

OTHER PUBLICATIONS

Notification of Transmittal of the International Search Report and the Written Opinion of the International Searching Authority, or the Declaration; PCT/US2020-028698; dated Aug. 3, 2020: ISR 3 pages, WO 6 pages, total: 9 pages.

* cited by examiner

*Primary Examiner* — Catherine Loikith

(74) *Attorney, Agent, or Firm* — Cantor Colburn LLP

(57) ABSTRACT

An apparatus includes a housing configured to be disposed in a borehole in a resource bearing formation, the housing including an axially extending fluid conduit configured to receive borehole fluid, and a seating assembly including a convertible component that is configured to be actuated to move the convertible component in a radial direction between an open position and a seating position. The convertible component extends radially into the fluid conduit and forms a landing seat for an object when in the seating position, and the convertible component allows passage of the object therethrough when in the open position.

20 Claims, 7 Drawing Sheets

SEATING ASSEMBLY INCLUDING A CONVERTIBLE LANDING SEAT

BACKGROUND

Exploration and production of hydrocarbons require a number of diverse activities from various engineering fields to be performed in a borehole penetrating an earth formation. Typically, exploration involves surveying and performing measurements known as logging using a survey or logging tool. Production generally involves activities such as drilling, installing permanent installations, casing perforation, hydraulic fracturing, formation evaluation, well integrity surveys, well stimulation, production logging, pressure pumping and cement evaluation.

There are a variety of tools and components that are actuated downhole to perform various functions. For example, packer assemblies are often used to isolate sections of a borehole and surrounding formation regions. Packer assemblies and other tools can be actuated in various ways, such as by electric, hydraulic and/or mechanical means. For example, a tool such as a packer assembly can be actuated by dropping a ball, dart or other object through a borehole string and seating the object on a receptacle, often referred to as a landing seat or a ball seat.

SUMMARY

An embodiment of an apparatus includes a housing configured to be disposed in a borehole in a resource bearing formation, the housing including an axially extending fluid conduit configured to receive borehole fluid, and a seating assembly including a convertible component that is configured to be actuated to move the convertible component in a radial direction between an open position and a seating position. The convertible component extends radially into the fluid conduit and forms a landing seat for an object when in the seating position, and the convertible component allows passage of the object therethrough when in the open position.

An embodiment of a method of forming a landing seat includes disposing a borehole string including a downhole device in a borehole in a resource bearing formation, the downhole device including a housing having an axially extending fluid conduit configured to receive borehole fluid, and a seating assembly having a convertible component. The method also includes actuating the seating assembly by moving the convertible component in a radial direction between an open position and a seating position. The convertible component extends radially into the fluid conduit and forms a landing seat for an object when in the seating position, and the convertible component allows passage of the object therethrough when in the open position.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method presented herein by way of exemplification and not limitation with reference to the figures.

Systems, apparatuses and methods are provided herein for actuating or operating downhole components. An embodiment of an apparatus includes a housing, an inner fluid conduit and a convertible seating assembly. The housing may be part of or attached to a borehole string, e.g., as a setting tool or as part of a downhole tool or component. The convertible seating assembly is configured to be operated or actuated when downhole to form a landing seat (e.g., a ball seat).

In one embodiment, the convertible seating assembly includes a convertible component that can be moved or otherwise actuated to an operable position in which all or part of the convertible component extends in a radial direction into the fluid conduit to form a landing seat. For example, the convertible component includes a collet portion having one or more segments. The collet portion is moveable from an open axial position in which the segments allow passage of a deployable (e.g., dropped or pumped) object such as a ball or dart through the collet portion, to a seating position in which the segments engage a protrusion that extends radially inwardly from a surface of the fluid conduit. In the seating position, the collet segments extend radially inwardly to an extent sufficient to receive the deployable component and prevent the deployable component from passing through the convertible seating assembly.

Embodiments described herein provide a number of advantages and technical effects. For example, the embodiments provide for a convertible or creatable landing seat that can be deployed in an open position to allow objects and tools to be deployed in a borehole string without obstruction. Thus, the embodiments allow for the maintenance of a large fluid conduit or bore that allows for various operations to be performed prior to a stimulation operation or other operation that utilizes a landing seat. In addition, the ability to maintain the convertible landing seat in an open position allows for multiple devices at multiple axial locations to be actuated with a single size ball or other object.

Figure 1:
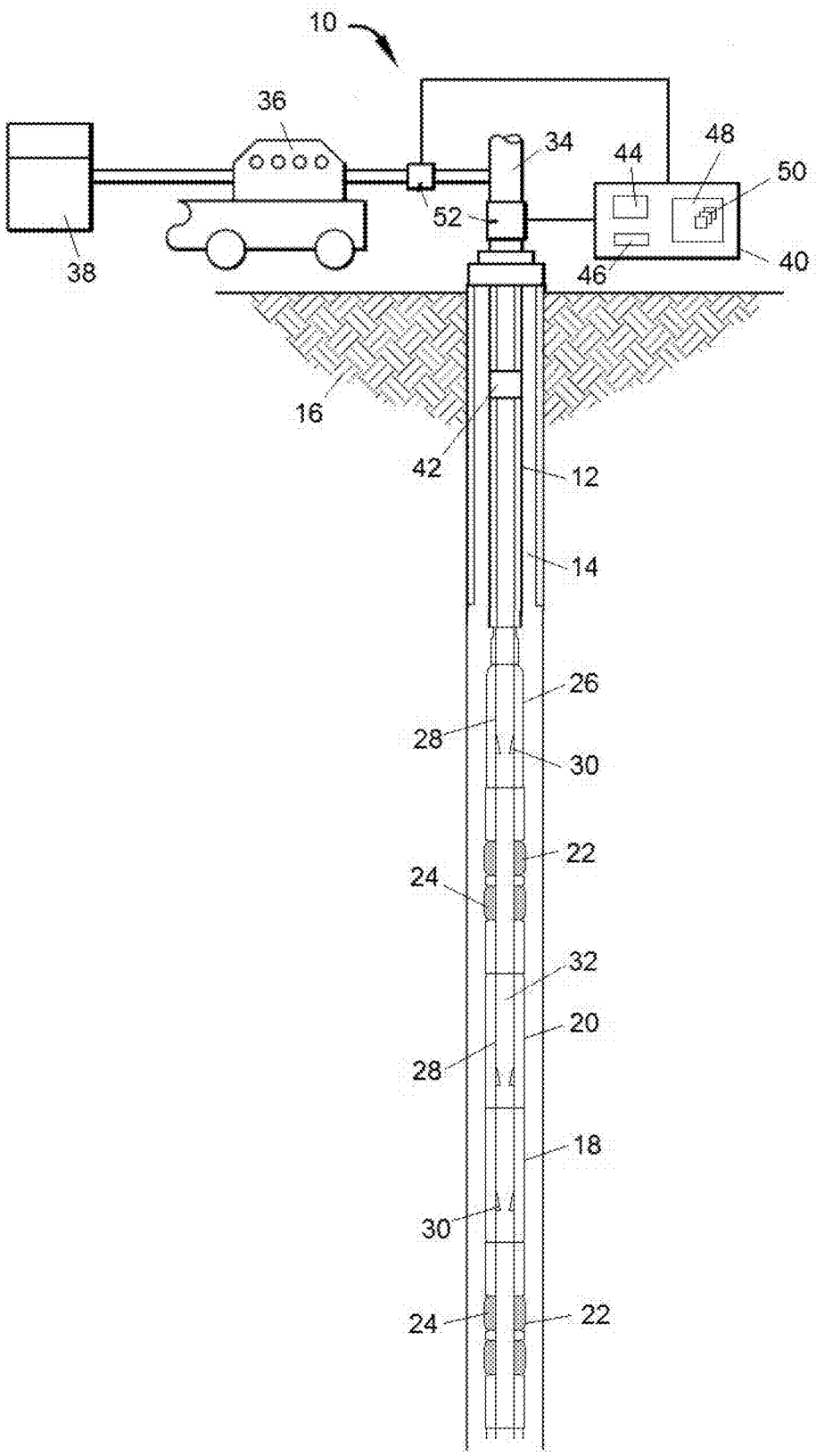
FIG. 1 illustrates an embodiment of a system for performing energy industry operations.

FIG. 1 illustrates an embodiment of a system 10 for performing energy industry operations. The system 10, in the embodiment of FIG. 1, is a completion and hydrocarbon production system 10. The system 10 is not so limited, and may be configured to perform any energy industry operation, such as a drilling, stimulation, measurement and/or production operation, or any other operation related to exploration and/or recovery of resources such as oil and gas.

A borehole string 12 including, e.g., a completion string, is configured to be disposed in a borehole 14 that penetrates a resource bearing formation 16 or formation region. The borehole 14 may be an open hole, a cased hole or a partially cased hole. The borehole string 12 may be configured for various uses, such as drilling, completion, stimulation and others, and includes a tubular, such as a coiled tubing, pipe (e.g., multiple pipe segments) or wired pipe, that extends from a wellhead at a surface location (e.g., at a drill site or offshore stimulation vessel). As described herein, a "string" refers to any structure or carrier suitable for lowering a tool or other component through a borehole or connecting a drill bit to the surface, and is not limited to the structure and configuration described herein.

In one embodiment, the borehole string 12 includes a completion and production string configured to be deployed in the borehole 14 to facilitate completion and/or stimulation of the borehole 14 or sections thereof. For example, the borehole string 12 includes a completion string having a production assembly 18 including a fracture or "frac" sleeve device, and/or a screen assembly 20. The borehole string 12 also includes one or more packer assemblies 22. Each packer assembly 22 includes one or more packer elements 24, which are configured to be actuated to expand or extend outwardly (i.e., toward a borehole wall) to isolate a section of the borehole 14. In one embodiment, the packer elements 24 are made from rubber or other suitable deformable material, and can be actuated, for example, by applying an axial force to the packer elements 24. The borehole string 12 may also include other components such as at least one setting assembly or device, which is referred to herein as a setting tool 26.

One or more downhole components, such as the setting tool 26, one or more packer assemblies 22, one or more frac sleeves and/or one or more screen assemblies 20, includes a seating assembly 28. Each seating assembly 28 includes at least one convertible or creatable component 30. The convertible component 30 can be moved or otherwise actuated between an open position and a seating position to convert the convertible component 30 or use the convertible component 30 to create a landing seat. As described herein, a landing seat is a configuration that forms a restricted portion of a fluid conduit that extends through the seating assembly 28 and/or a component that includes the seating assembly 28.

The landing seat is configured to receive a deployable object. The deployable object may be a ball, dart or other object that is deployed into the borehole string 12 by dropping and/or advancing the object by fluid pressure. When the deployable object is seated on the landing seat, fluid flow through the seating assembly 28 is restricted or prevented entirely. As a result, fluid exerts pressure on the deployable object and the landing seat, which can be used to move or actuate a downhole component. For example, as discussed further below, the seating assembly 28 and the convertible component 30 can be operably connected to a moveable sleeve, so that pressure on the deployable object and the landing seat moves the sleeve to actuate a component, open a flow path or perform other function in the conduit.

In one embodiment, the seating assembly 28 is configured to be actuated to move the convertible component 30 in a radial direction between an open position and a seating position. When the seating assembly 28 and the convertible component 30 are in the open position, the convertible component 30 allows passage of the object through or past the seating assembly 28. For example, the convertible component 30 includes one or more radially extendable segments that can be moved from the open position, in which the segments do not extend sufficiently into the fluid conduit to stop the deployable object, to the seating position, in which the segment(s) extend to an extent sufficient to stop the deployable object (i.e., land the object).

In one embodiment, fluid pressure is applied by to the deployable object, when seated, by borehole fluid that is circulated through the borehole 14. For example, the borehole string includes a central conduit 32 that extends from surface equipment 34 to an end of the borehole string 12 or to a selected location along the borehole string. The seating assembly 28 includes a fluid conduit that is part of the central conduit 32 or is otherwise in fluid communication with the central conduit 32.

Borehole fluid can be injected into the borehole 14 by the surface equipment 34. The surface equipment 34 includes components such as a drill rig, rotary table, top drive and/or others to facilitate deploying the borehole string 12, operating various downhole components, monitoring downhole conditions and controlling fluid circulation through the borehole 14 and the borehole string 12. In one embodiment, the surface equipment 34 includes an injection device such as a pump 36 in fluid communication with a fluid tank 38 or other fluid source. The pump 36 facilitates injection of fluids, such as drilling fluid (e.g., drilling mud), stimulation fluid (e.g., a hydraulic fracturing fluid), gravel slurries, proppant and others.

In one embodiment, the system 10 includes a processing device such as a surface processing unit 40, and/or a subsurface processing unit 42 disposed in the borehole 14 and connected to one or more downhole components. The processing device may be configured to perform functions such as controlling drilling and steering, controlling fluid flow, controlling downhole components, transmitting and receiving data, processing measurement data and/or monitoring operations. In addition, the processing device may control aspects of fluid circulation, such as fluid pressure and/or flow rate into the borehole string 12.

The surface processing unit 40, in one embodiment, includes a processor 44, an input/output device 46 and a data storage device (or a computer-readable medium) 48 for storing data, files, models, data analysis modules and/or computer programs. For example, the storage device 48 stores processing modules 50 for performing functions such as controlling fluid circulation, controlling the downhole components, collecting data, communicating with downhole components, storing data, and/or performing data analysis.

Various sensors and/or measurement tools may be included in the system 10 at surface and/or downhole locations. For example, one or more flow rate and/or pressure sensors 52 may be disposed in fluid communication with the pump 36 and the borehole string 12 for measurement of fluid characteristics. The sensors 52 may be positioned at any suitable location, such as proximate to or within the pump 36, at or near the surface, or at any other location along the borehole string 12 or the borehole 14.

FIGS. 2-7B show examples of configurations and uses of the seating assembly 28. These examples are discussed in the context of a method of operating a downhole component, which includes converting the convertible component 30 into a ball seat or other landing seat. As discussed further, the landing seat is described as a ball seat, and the deployable object is described as a ball that is dropped into the borehole string 12. It is noted that this description is not intended to be limiting, as the landing seat and the deployable object can have any suitable form or configuration such that fluid flow is restricted or prevented upon landing the deployable object on the landing seat created via the convertible component 30.

The method includes creating a landing seat downhole by actuating a convertible component to move the convertible component radially inwardly into a fluid conduit, thereby creating a ball seat or landing seat. The created landing seat can be used to actuate or operate any of various components. For example, the landing seat can be used to set a packer assembly 22, operate the screen assembly 20, operate the production assembly 18 (e.g., by shifting a screen). In addition, the landing seat can be used to open or close a valve, open or close a fluid port, activate a perforation device, and/or employed in any suitable context.

The method includes deploying the borehole string 12, which includes a seating assembly 28. The seating assembly 28 may be incorporated into a setting tool or any other tool or component deployed with the borehole string 12. The seating assembly 28 is deployed in an open position, in which the convertible component 30 allows fluid and objects (e.g., the deployable object and other objects of various sizes) to pass through the seating assembly 28. The method also includes actuating the seating assembly 28 to convert the convertible component 30 to a ball seat by moving all or part of the convertible component 30 to a seating position in which at least part of the convertible component extends in a radially inward direction to create a restriction that prevents a dropped ball from moving past the convertible component 30. The convertible component 30 can be attached to an actuator (e.g., an actuation sleeve or valve) so that fluid pressure on the ball is transferred as a force on the actuator.

The method may include releasing the ball from the convertible component. For example, the ball can be released by increasing fluid pressure to a level that causes the convertible component (when in the operable position) to deform and allow the ball to be released, allowing the ball and/or the convertible component to degrade, or by moving the convertible component back to the open position. It is noted that the method may be performed by a processor such as the surface processing unit 40, or parts of the method may be performed by a human operator.

Figure 2:
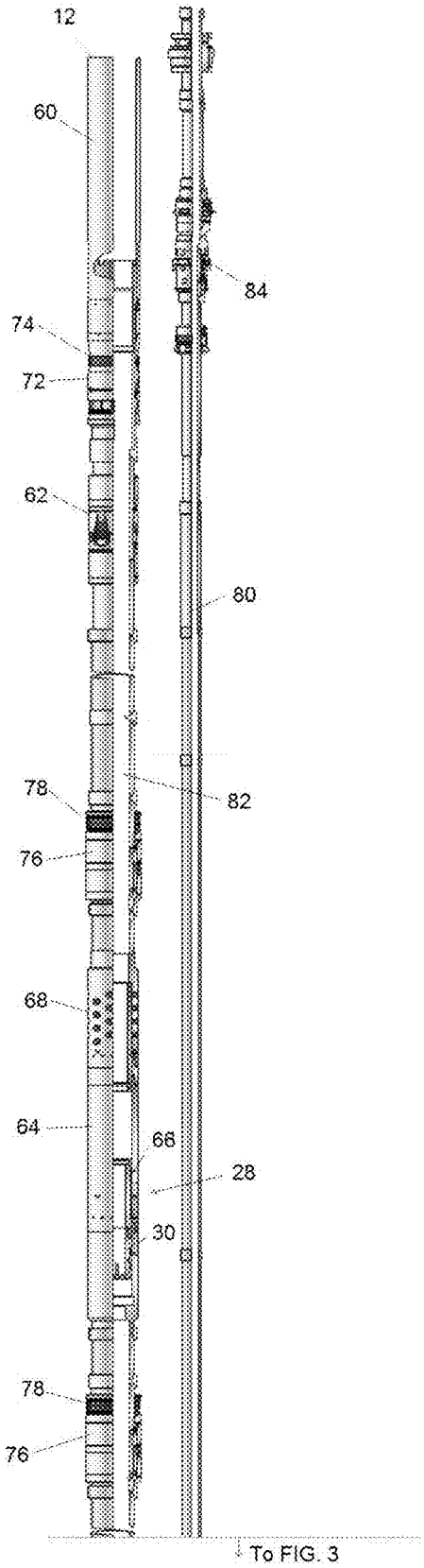
FIG. 2 depicts a portion of an embodiment of a completion string and an inner string configured to actuate components of the completion string, the completion string including a seating assembly having a convertible component.
Figure 3:
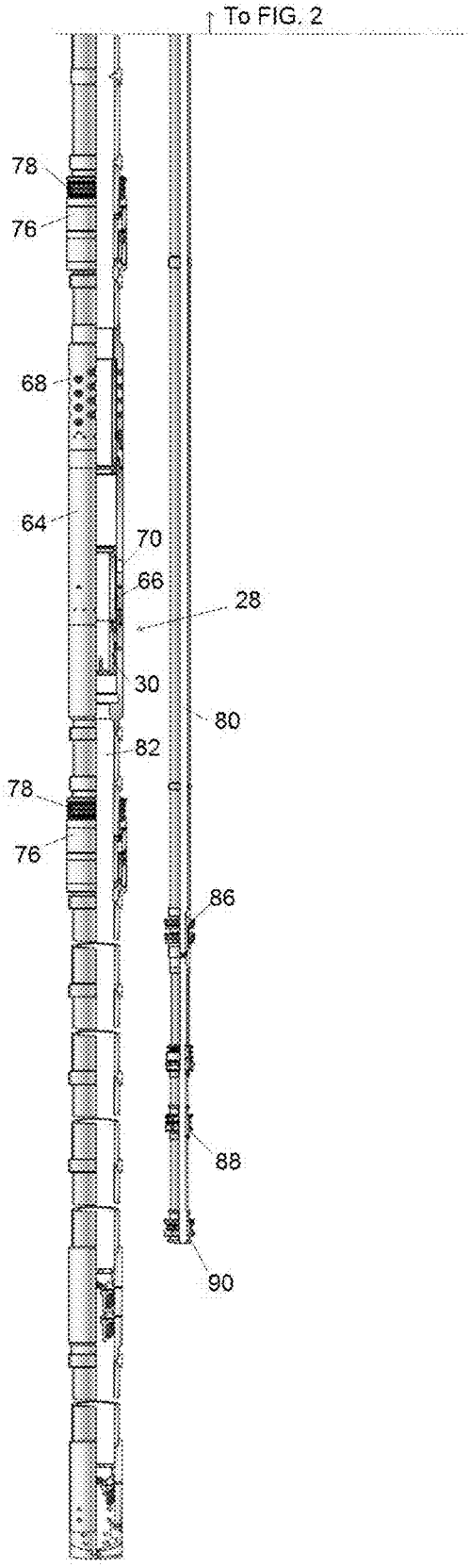
FIG. 3 depicts another portion of the completion string and the inner string of FIG. 2.
Figure 4:
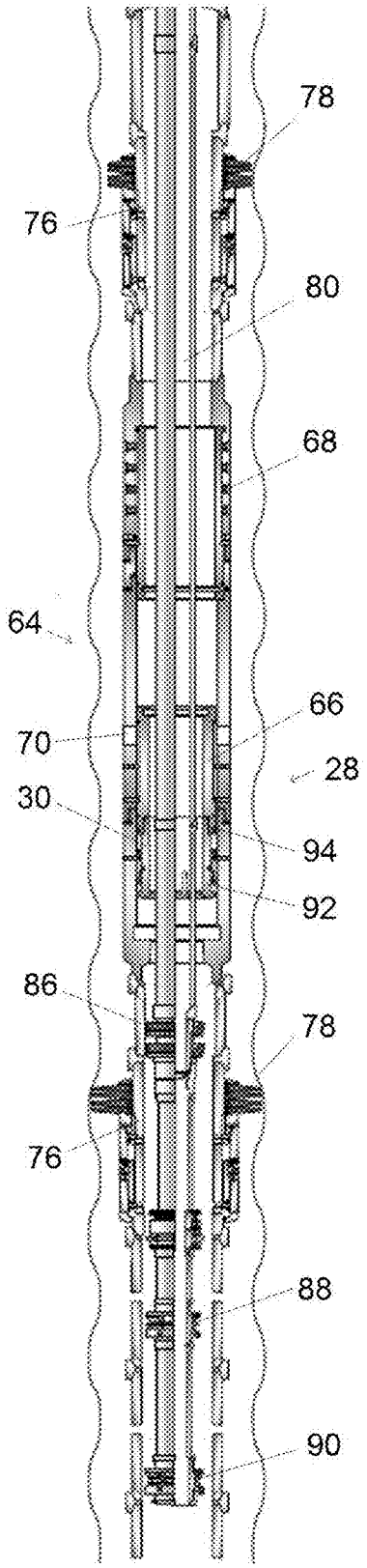
FIG. 4 is a cross-sectional view of a fracturing and production assembly disposed in a borehole as part of the completion string of FIGS. 2 and 3, the fracturing and production assembly including a screen, a fracture sleeve and the seating assembly having the convertible component.

Referring to FIGS. 2-7B, an embodiment of the borehole string 12 including a convertible seating assembly 28 is a completion string having components for facilitating completion of a borehole and/or production from a formation. FIG. 2 shows an upper portion (i.e., the portion closer along a borehole to the surface when deployed) and FIG. 3 shows a lower portion (i.e., the portion further along the borehole from the surface when deployed) of the borehole string 12. It is noted that an "upper" location or component is a location or component closer to the surface along a borehole, and a "lower" location or component is a location or component further from the surface along the borehole. Upper and lower do not necessarily correspond to depth, as the borehole 12 may be horizontal and/or deviated. As such, upper and lower locations may have the same depth, or an upper location may have a lower depth than a lower location.

In this embodiment, the borehole string 12 includes a liner 60, a liner hanger 62 and one or more fracturing and production assemblies 64. Each fracturing and production assembly 64 includes a fracturing or "frac" sleeve 66 and a sand control screen 68. The frac sleeve 66 is operated to open one or more fluid ports 70 to permit fluid pressure to be applied to a formation to initiate fractures. The sand control screen 68 is provided to prevent sand and other particulates and solids from entering the borehole string 12 during production.

A number of packer assemblies (also referred to as packers) are located along the borehole string and are configured to be actuated to isolate a section of the borehole 12. For example, the borehole string 12 includes a top packer 72 having one or more packing elements 74, and one or more open hole packers 76 having one or more packing elements 78 for establishing production zones.

In this embodiment, the system 10 also includes an inner string 80 configured to be deployed through a central bore or fluid conduit 82 of the borehole string 12 for setting or actuating various tools. The inner string 80 includes a top packer setting tool 84 for setting the top packer 72, a swab cup assembly 86 including an extrudable ball seat, an upper sleeve shifting tool 88 and a lower sleeve shifting tool 90.

A convertible seating assembly 28 is included in or connected to each fracturing and production assembly 64. Each convertible seating assembly 28 includes a convertible component 30 having a collet portion 92 and an actuation portion or actuator 94. The actuator 94 is configured in this embodiment as an actuator sleeve 94, but is not so limited and can be any device or component configured to move the collet portion 92 into the seating position.

Figure 5A:
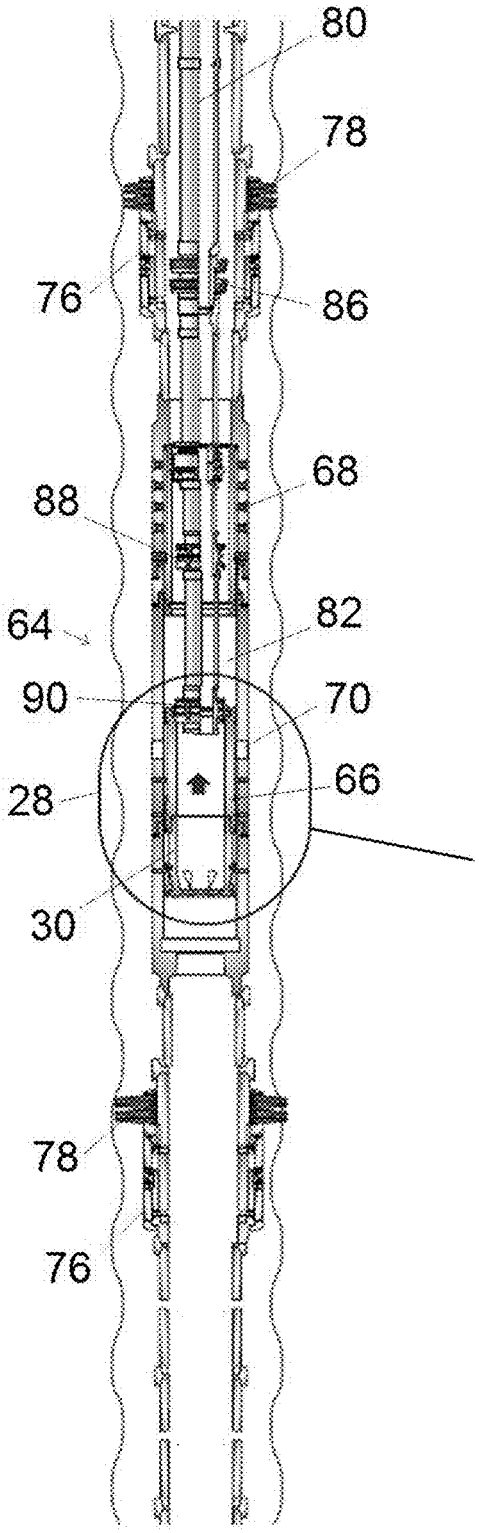
FIG. 5A is a cross-sectional view of the fracturing and production assembly of FIG. 4, which depicts conversion of the convertible component into a landing seat.
Figure 5B:
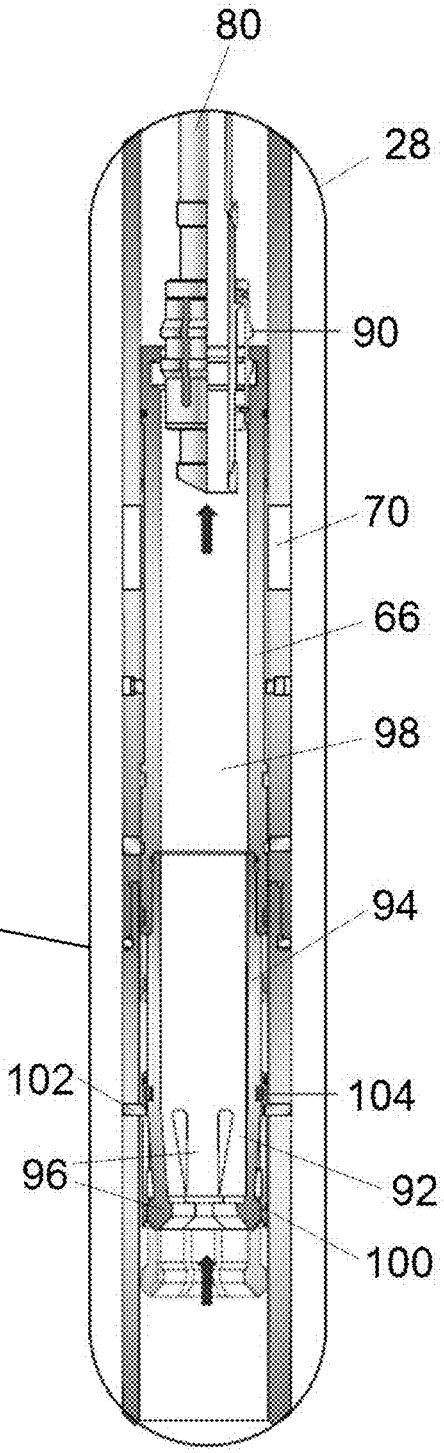
FIG. 5B is an enlarged view of the convertible component shown in FIG. 5A.

As shown in FIGS. 5A and 5B, in one embodiment, the collet portion 92 includes one or more collet segments 96 that are deformable to move radially inwardly away from an inner surface of a fluid conduit 98. The fluid conduit 98, in one embodiment, is part of the central fluid conduit 82 of the borehole string 12.

The collet portion 92 can be moved radially inwardly to create a landing seat in any suitable manner. For example, the collet portion 92 can be moved by applying a mechanical force by an actuator sleeve as discussed below, or moved by an actuator in response to an electrical or telemetry signal. In another example, the collet portion 92 can be coupled to a hydraulic line or fluid source to allow the collet portion 92 to be moved hydraulically.

In addition, the moveable component 30 is not limited to a collet, but can include any member or component that can be moved radially to form a ball seat. For example, the moveable component can include one or more pistons or members that are actuated to move axially into the fluid conduit, members that rotate to move into the fluid conduit 98, or an expandable component such as a bladder that is expanded by fluid pressure.

Referring again to FIGS. 5A and 5B, in one embodiment, the seating assembly 28 includes one or more protrusions that extend radially inwardly from the inner surface. For example, the one or more protrusions are configured as a conversion ring 100 located at the inner surface. To move the seating assembly 28 into the seating position, the actuator sleeve 94 can be pushed or pulled axially to bring the collet segments 96 into engagement with the conversion ring 100. The conversion ring 100 forces the segments 96 inward, thereby collapsing the collet portion 92 to form a ball seat. In one embodiment, the inner surface of the fluid conduit 98 includes a shoulder 102 that prevents upward movement of the conversion ring 100 but allows the conversion ring 100 to move with the collet portion 92 in a downward direction. The seating assembly may also include a locking ring 104 that maintains the collet segments 96 in the seating position.

As described herein, an axial direction refers to a longitudinal direction along the borehole string 12, the seating assembly 28 and//or the borehole 14. A radial direction is at least partially perpendicular to the axial direction. An inward direction refers to a radial direction toward the interior of the borehole string 12, and an outward direction is toward the borehole wall or annulus.

FIGS. 4-7B illustrate various aspects of a fracturing and completion operation, which includes the above-described method of operating a downhole component. During the operation, the inner string 80 is deployed, pressure is increased to a first level to set the hanger 62, and then subsequently increased again to set the top packer 72 and the open hole packers 76. At this point, shown in FIG. 4, the upper and lower shifting tools are located away from the seating assembly 28. Also at this point, the seating assembly 28 is in an open position, at which the collet segments 96 rest against the inner surface of the fluid conduit 98. The collet segments 69 in the open position establish an opening that is wide enough to allow fluid and components such as balls, darts and running tools to pass through without being obstructed.

Referring to FIGS. 5A and 5B, the seating assembly 28 is actuated to move the collet portion 92 to the seating position. As shown, the lower shifting tool 90 is pulled upward to engage the lower shifting tool 90 with the frac sleeve 66, and then pulled further upward to pull the actuator sleeve 94 and move the collet portion 92 axially into engagement with the conversion ring 100. The conversion ring 100 causes the collet portion 92 and the segments 96 to collapse and form a ball seat. In one embodiment, the collet portion 92 or the actuator sleeve 94 includes a locking ring 104 that engages a feature on the conversion ring 100 so that the collet portion 92 remains fixed relative to the conversion ring 100 when the seating assembly is moved.

Figure 6A:
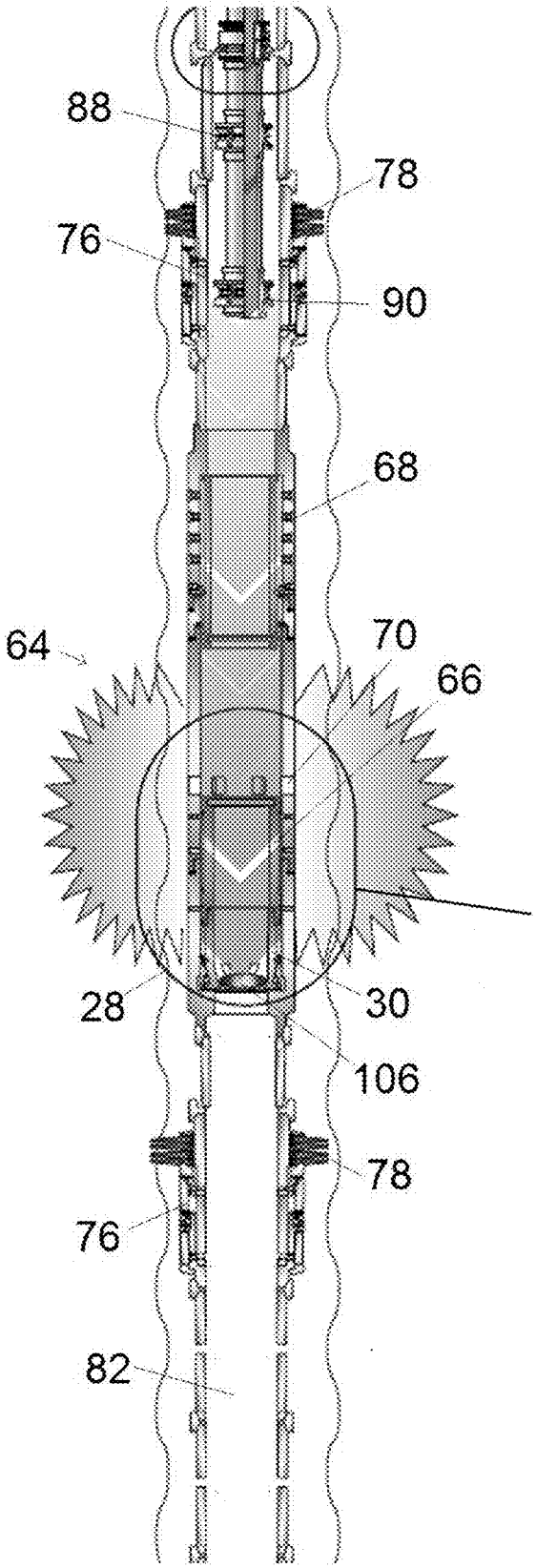
FIG. 6A is a cross-sectional view of the fracturing and production assembly of FIGS. 4 and 5, which depicts the fracturing of a formation region by landing a ball on the landing seat.
Figure 6B:
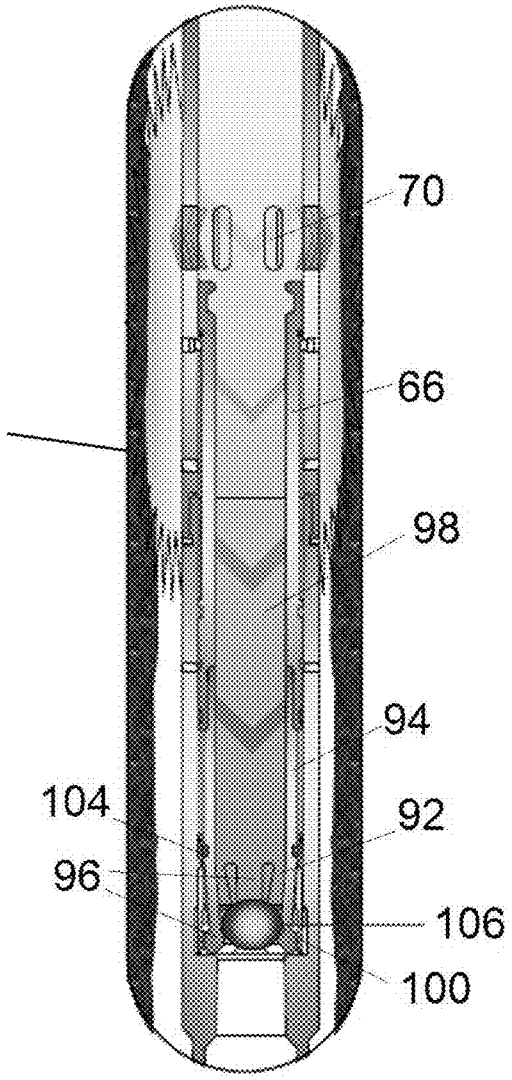
FIG. 6B is an enlarged view of the convertible component shown in FIG. 6A.
Figure 7A:
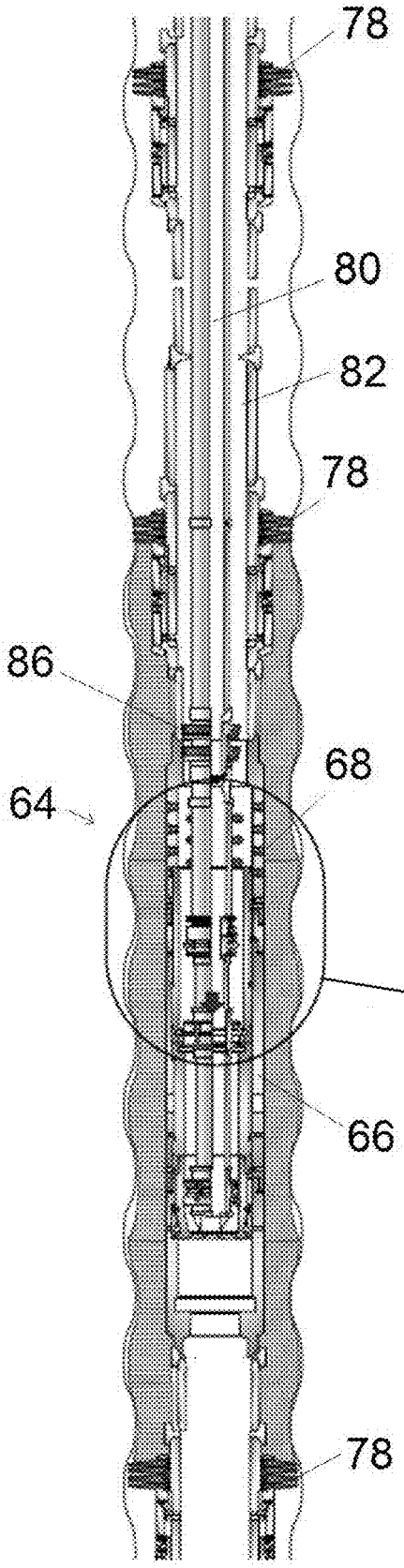
FIG. 7A is a cross-sectional view of the fracturing and production assembly of FIGS. 4-6, which depicts shifting of the screen subsequent to fracturing.
Figure 7B:
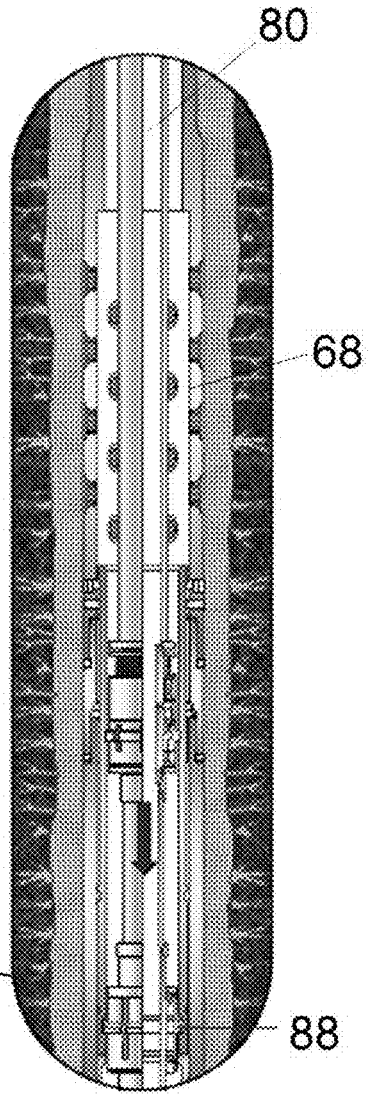
FIG. 7B is an enlarge view of a portion of the fracturing and production assembly shown in FIG. 7A.

Referring to FIGS. 6A and 6B, a zone of the formation is fractured by dropping a ball 106 and landing the ball 106 on the created ball seat formed by the collet segments 96. Once the ball 106 is seated, pressure is increased to shift the frac sleeve 66, expose the fracture ports 70 and fracture the formation. Subsequently, the lower shifting tool 90 can be positioned to reengage the frac sleeve 66 and close the fracturing ports. Gravel or sand can then be pumped downhole to create a gravel pack Referring to FIGS. 7A and 7B, after the formation has been fractured and the gravel pack is formed, the upper shifting tool 88 is lowered and engages the screen 68. The screen 68 is lowered to move the screen to the fractured formation and allow production.

In one embodiment, the method can be continued to fracture and complete other zones. For example, the inner string 80 can be pulled upward to another fracturing and production assembly 64 and the method is repeated. It is noted that each seating assembly 28 can be configured to use the same size ball, permitting any number of zones to be fractured and completed.

The seating assembly 28 is not limited to conversion to a ball seat having a single size. For example, the seating assembly 28 can be configured to be actuated to variable sizes. For example, the seating assembly 28 can have multiple conversion rings 100, each extending into the inner fluid conduit 98 by a different distance. The lower shifting tool 90 can pull the collet portion 92 to a first axial position co-located with one ring to establish a landing seat having a first size, and subsequently move the collet portion 92 to a second axial location co-located with another ring to establish a landing seat having a different size. In this way, the seating assembly 28 can be used to create landing seats having different sizes. The conversion ring 100 can itself have multiple protrusion distances.

Set forth below are some embodiments of the foregoing disclosure:

Embodiment 1

An apparatus comprising: a housing configured to be disposed in a borehole in a resource bearing formation, the housing including an axially extending fluid conduit configured to receive borehole fluid; and a seating assembly including a convertible component, the convertible component configured to be actuated to move the convertible component in a radial direction between an open position and a seating position, wherein the convertible component extends radially into the fluid conduit and forms a landing seat for an object when in the seating position, and the convertible component allows passage of the object therethrough when in the open position.

Embodiment 2

The apparatus of any prior embodiment, wherein the object is configured to be dropped into a borehole string and advanced to the housing by at least one of gravity and fluid pressure.

Embodiment 3

The apparatus of any prior embodiment, wherein the seating assembly includes an actuation device configured to move the convertible component axially from a first axial location to a second axial location.

Embodiment 4

The apparatus of any prior embodiment, wherein the actuation device is selected from at least one of an actuation sleeve and a setting tool configured to be disposed in and moved along the fluid conduit.

Embodiment 5

The apparatus of any prior embodiment, wherein the convertible component is in the open position when the convertible component is at the first axial location, and the convertible component is in the seating position when the convertible component is at the second axial location.

Embodiment 6

The apparatus of any prior embodiment, wherein the seating assembly includes a protrusion disposed at the second axial location and extending radially inwardly from an inner surface of the fluid conduit, the protrusion configured to urge the convertible component to the seating position when the convertible component is at the second axial location.

Embodiment 7

The apparatus of any prior embodiment, wherein the convertible component is a collet having one or more segments configured to be moved radially to form the landing seat.

Embodiment 8

The apparatus of any prior embodiment, wherein the collet forms a plurality of segments arrayed circumferentially and disposed proximate to an inner surface of the fluid conduit.

Embodiment 9

The apparatus of any prior embodiment, wherein the seating assembly includes a protrusion that extends radially inwardly from an inner surface of the fluid conduit, the protrusion configured to urge the one or more segments to the seating position.

Embodiment 10

The apparatus of any prior embodiment, wherein the convertible component is configured to be attached to an actuation sleeve, the convertible component configured to receive the object in the landing seat and apply a force on the actuation sleeve to move the actuation sleeve in response to fluid pressure on the object and the landing seat.

Embodiment 11

A method of forming a landing seat, comprising: disposing a borehole string including a downhole device in a borehole in a resource bearing formation, the downhole device including a housing having an axially extending fluid conduit configured to receive borehole fluid, the downhole device including a seating assembly having a convertible component; and actuating the seating assembly by moving the convertible component in a radial direction between an open position and a seating position, wherein the convertible component extends radially into the fluid conduit and forms a landing seat for an object when in the seating position, and the convertible component allows passage of the object therethrough when in the open position.

Embodiment 12

The method of any prior embodiment, further comprising dropping the object into the borehole string, advancing the object to the housing by at least one of gravity and fluid pressure, and seating the object on the landing seat.

Embodiment 13

The method of any prior embodiment, wherein actuating the seating assembly includes moving the convertible component axially from a first axial location to a second axial location by an actuation device.

Embodiment 14

The method of any prior embodiment, wherein the actuation device is selected from at least one of an actuation sleeve and a setting tool configured to be disposed in and moved along the fluid conduit.

Embodiment 15

The method of any prior embodiment, wherein the convertible component is in the open position when the convertible component is at the first axial location, and the convertible component is in the seating position when the convertible component is at the second axial location.

Embodiment 16

The method of any prior embodiment, wherein the seating assembly includes a protrusion disposed at the second axial location and extending radially inwardly from an inner surface of the fluid conduit, the protrusion configured to urge the convertible component to the seating position when the convertible component is at the second axial location.

Embodiment 17

The method of any prior embodiment, wherein the convertible component is a collet having one or more segments configured to be moved radially to form the landing seat.

Embodiment 18

The method of any prior embodiment, wherein the collet forms a plurality of segments arrayed circumferentially and disposed proximate to an inner surface of the fluid conduit.

Embodiment 19

The method of any prior embodiment, wherein the seating assembly includes a protrusion disposed at an axial location along the fluid conduit and extending radially inwardly from an inner surface of the fluid conduit, and actuating the seating assembly includes moving the convertible component to the axial location and urging the one or more segments to the seating position by the protrusion.

Embodiment 20

The method of any prior embodiment, wherein the convertible component is configured to be attached to an actuation sleeve, and the method further comprises receiving the object in the landing seat, and applying a force on the actuation sleeve to move the actuation sleeve in response to fluid pressure on the object and the landing seat.

In support of the teachings herein, various analysis components may be used, including a digital and/or an analog system. For example, embodiments such as the system 10, downhole tools, hosts and network devices described herein may include digital and/or analog systems. Embodiments may have components such as a processor, storage media, memory, input, output, wired communications link, user interfaces, software programs, signal processors (digital or analog), signal amplifiers, signal attenuators, signal converters and other such components (such as resistors, capacitors, inductors and others) to provide for operation and analyses of the apparatus and methods disclosed herein in any of several manners well-appreciated in the art. It is considered that these teachings may be implemented in conjunction with a set of computer executable instructions stored on a non-transitory computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Elements of the embodiments have been introduced with either the articles "a" or "an." The articles are intended to mean that there are one or more of the elements. The terms "including" and "having" are intended to be inclusive such that there may be additional elements other than the elements listed. The conjunction "or" when used with a list of at least two terms is intended to mean any term or combination of terms. The terms "first," "second" and the like do not denote a particular order, but are used to distinguish different elements.

While one or more embodiments have been shown and described, modifications and substitutions may be made thereto without departing from the spirit and scope of the invention. Accordingly, it is to be understood that the present invention has been described by way of illustrations and not limitation.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus comprising:

a housing configured to be deployed in a borehole in a resource bearing formation, the housing including an axially extending fluid conduit configured to receive borehole fluid; and a seating assembly including a convertible component, the convertible component configured to be deployed into the borehole in an open position, and actuated to move the convertible component in a radially inward direction from the open position to a seating position and maintain the convertible component in the seating position, wherein the convertible component extends radially into the fluid conduit and forms a landing seat when in the seating position, and the convertible component allows passage of an object therethrough when in the open position, wherein the seating position includes a first position and a second position, the convertible component extending a first distance into the fluid conduit when in the first position and configured to form a first landing seat for a first object, and extending a second distance into the fluid conduit when in the second position and configured to form a second landing seat for a second object, the first distance being different than the second distance.

2. The apparatus of claim 1, wherein the convertible component is configured to be deployed in the open position prior to deployment of the object to the seating assembly.

3. The apparatus of claim 1, wherein the seating assembly includes an actuation device configured to move the convertible component axially from a first axial location to a second axial location.

4. The apparatus of claim 3, wherein the actuation device is selected from at least one of an actuation sleeve and a setting tool configured to be disposed in and moved along the fluid conduit.

5. The apparatus of claim 3, wherein the convertible component is in the open position when the convertible component is at the first axial location, and the convertible component is in the seating position when the convertible component is at the second axial location.

6. The apparatus of claim 5, wherein the seating assembly includes a first protrusion disposed at the second axial location and extending radially inwardly from an inner surface of the fluid conduit, the protrusion configured to urge the convertible component to the first position when the convertible component is at the second axial location.

7. The apparatus of claim 6, wherein the seating assembly includes a second protrusion disposed at a third axial location, the second protrusion configured to urge the convertible component to the second position when the convertible component is at the third axial location.

8. The apparatus of claim 1, wherein the convertible component is a collet that forms a plurality of segments arrayed circumferentially and disposed proximate to an inner surface of the fluid conduit.

9. The apparatus of claim 8, wherein the seating assembly includes a protrusion that extends radially inwardly from an inner surface of the fluid conduit, the protrusion configured to urge the plurality of segments to the seating position.

10. The apparatus of claim 1, wherein the convertible component is configured to be attached to an actuation sleeve, the convertible component configured to receive the object in the landing seat and apply a force on the actuation sleeve to move the actuation sleeve in response to fluid pressure on the object and the landing seat.

11. A method of forming a landing seat, comprising:

deploying a borehole string including a downhole device in a borehole in a resource bearing formation, the downhole device including a housing having an axially extending fluid conduit configured to receive borehole fluid, the downhole device including a seating assembly having a convertible component, the convertible component being in an open position during the deploying; and actuating the seating assembly by moving the convertible component in a radially inward direction from the open position to a seating position and maintaining the convertible component in the seating position, wherein the convertible component extends radially into the fluid conduit and forms a landing seat when in the seating position, and the convertible component allows passage of an object therethrough when in the open position, wherein the seating position includes a first position and a second position, the convertible component extending a first distance into the fluid conduit when in the first position and forming a first landing seat for a first object, and extending a second distance into the fluid conduit when in the second position and forming a second landing seat for a second object, the first distance being different than the second distance.

12. The method of claim 11, wherein the convertible component is deployed in the open position prior to deployment of the object to the seating assembly.

13. The method of claim 11, wherein actuating the seating assembly includes moving the convertible component axially from a first axial location to a second axial location by an actuation device.

14. The method of claim 13, wherein the actuation device is selected from at least one of an actuation sleeve and a setting tool configured to be disposed in and moved along the fluid conduit.

15. The method of claim 13, wherein the convertible component is in the open position when the convertible component is at the first axial location, and the convertible component is in the seating position when the convertible component is at the second axial location.

16. The method of claim 15, wherein the seating assembly includes a first protrusion disposed at the second axial location and extending radially inwardly from an inner surface of the fluid conduit, the protrusion configured to urge the convertible component to the first position when the convertible component is at the second axial location.

17. The method of claim 16, wherein the seating assembly includes a second protrusion disposed at a third axial location, the second protrusion configured to urge the convertible component to the second seating position when the convertible component is at the third axial location.

18. The method of claim 11, wherein the convertible component is a collet that forms a plurality of segments arrayed circumferentially and disposed proximate to an inner surface of the fluid conduit.

19. The method of claim 18, wherein the seating assembly includes a protrusion disposed at an axial location along the fluid conduit and extending radially inwardly from an inner surface of the fluid conduit, and actuating the seating assembly includes moving the convertible component to the axial location and urging the plurality of segments to the seating position by the protrusion.

20. The method of claim 11, wherein the convertible component is configured to be attached to an actuation sleeve, and the method further comprises receiving the object in the landing seat, and applying a force on the actuation sleeve to move the actuation sleeve in response to fluid pressure on the object and the landing seat.

* * * * *